US007213692B2

(12) United States Patent
Wang et al.

(10) Patent No.: US 7,213,692 B2
(45) Date of Patent: May 8, 2007

(54) CARRY-ON BAGGAGE CONTAINER WITH A FOLDING CHAIR

(75) Inventors: Teng Yi Wang, Taipei (TW); Chang I Wu, Taipei (TW)

(73) Assignee: Shen-Tai Industry Co., Ltd., Taipei (TW)

( * ) Notice: Subject to any disclaimer, the term of this patent is extended or adjusted under 35 U.S.C. 154(b) by 600 days.

(21) Appl. No.: 10/792,873

(22) Filed: Mar. 5, 2004

(65) Prior Publication Data

US 2005/0194226 A1 Sep. 8, 2005

(51) Int. Cl.
*A47C 7/62* (2006.01)
*A45C 5/00* (2006.01)

(52) U.S. Cl. ..... 190/8; 297/188.01; 297/188.13

(58) Field of Classification Search ..... 190/1, 190/8; 297/188.01, 188.13, 188.12; 383/4
See application file for complete search history.

(56) References Cited

U.S. PATENT DOCUMENTS 4,846,486 A * 7/1989 Hobson ..... 280/47.25
5,374,073 A * 12/1994 Hung-Hsin ..... 280/30
5,507,508 A * 4/1996 Liang ..... 280/37
5,779,112 A * 7/1998 Krulik ..... 224/155
6,932,427 B2 * 8/2005 Tamura ..... 297/217.1
6,986,445 B1 * 1/2006 Stockman ..... 224/155
7,040,635 B1 * 5/2006 Remole ..... 280/47.18

* cited by examiner

*Primary Examiner*—Tri M. Mai
(74) *Attorney, Agent, or Firm*—Troxell Law Office, PLLC

(57) ABSTRACT

A carry-on baggage container is provided on one surface with a folding chair, which includes a base portion fixedly attached to the baggage container surface, a seat portion pivotally connected at a rear end to a top of the base portion, and a leg portion pivotally connected at an upper end to a front crossbar of the seat portion. The leg portion includes two slant stays pivotally connected at outer ends to two lateral sides of the leg portion and at flat and bent inner ends to a flat section at a first end of a central bar, of which a second end is pivotally connected to a rear crossbar of the seat portion. The folding chair is normally in a folded position flatly attached to the baggage container and can be readily turned to an extended position for use.

5 Claims, 7 Drawing Sheets

CARRY-ON BAGGAGE CONTAINER WITH A FOLDING CHAIR

FIELD OF THE INVENTION

The present invention relates to a carry-on baggage container with a folding chair, and more particularly to a carry-on bag or trunk provided with a folding chair that may be pivotally turned relative to the bag or trunk to an extended position for use at any time at any place.

BACKGROUND OF THE INVENTION

A traveler, either a tourist or a businessman, would usually have one or more containers, such as trunks, knapsacks or bags, for carry-on baggage. These carry-on baggage containers are normally very heavy with various kinds of articles loaded therein. Many currently available carry-on baggage containers are equipped with wheels to allow easy movement of them effortlessly.

Even if the currently available carry-on baggage containers are equipped with wheels and can be effortlessly moved around, they are still a burden to the traveler, particular a traveler on a long-distant trip or a transit passenger, who is very tired at the end of the travel, and hardly has strength to handle the carry-on baggage.

Frequently, a traveler also has to wait for boarding in the waiting room for a considerably long time, particularly at an airport that executes strict passenger inspection and requires passengers to check in as early as possible. And, it is apparent an unpleasant experience to wait in a crowded waiting room and can hardly find a seat to take a rest.

SUMMARY OF THE INVENTION

A primary object of the present invention is to provide a carry-on baggage container with a folding chair, so that a traveler may pivotally turn the folding chair relative to the baggage container to an extended position for use conveniently.

To achieve the above and other objects, the carry-on baggage container of the present invention is provided on one surface with a folding chair, which includes a base portion fixedly attached to the container surface, a seat portion pivotally connected at an end to a top of the base portion, and a leg portion pivotally connected at an upper end to a front crossbar of the seat portion. The leg portion includes two slant stays pivotally connected at outer ends to two lateral sides of the leg portion and at inner ends to a first end of a central bar, of which a second end is pivotally connected to a rear crossbar of the seat portion. The folding chair is normally in a folded position flatly attached to the surface of the baggage container and can be readily turned to an extended position for use.

In an operable embodiment of the present invention, the folding chair on the carry-on baggage container is located in covers provided with zippers.

In a preferred embodiment of the present invention, the first end of the central bar is a flat section of a predetermined length, and the inner ends of the two slant stays are flat and bent sections adapted to pivotally connect to the flat section of the central bar. And, a locating ring is movably put on the flat section of the central bar, and a stopper is fixedly provided at an outmost point of the flat section.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
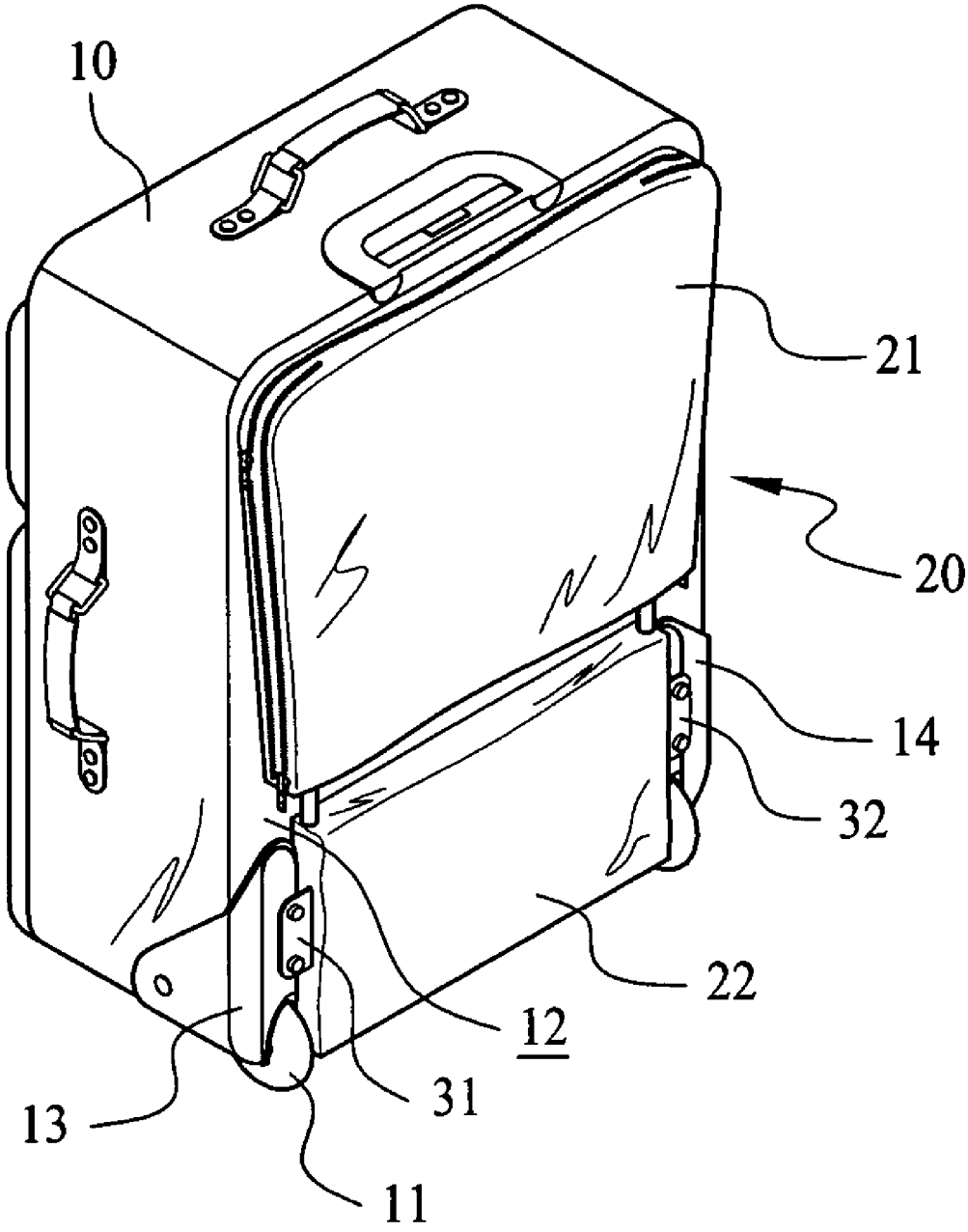
FIG. 1 is a perspective view of a carry-on baggage container with a folding chair according to a preferred embodiment of the present invention.

Please refer to FIG. 1 that is a perspective view of a carry-on baggage container 10 with a folding chair 20 according to a preferred embodiment of the present invention. The carry-on baggage container 10 is a traveling case or trunk provided with wheels 11 and can therefore be easily pulled by and carried along with a user. In the present invention, the carry-on baggage container 10 is provided at one surface 12 (it is a rear surface of the baggage container 10 in the illustrated embodiment) with a folding chair 20, which is normally folded to flatly attach to the rear surface 12 of the baggage container 10. That is, when the folding chair 20 is not in use, it is in a folded position flatly bearing against the rear surface 12. In the illustrated embodiment, different parts of the folding chair 20 are received in covers 21, 22 that are provided with zippers or other functionally equivalent fastening means, so that the zippers may be pulled to open the covers 21, 22 by predetermined lengths to allow turning of the folding chair 20 to an extended position for use.

Figure 2:
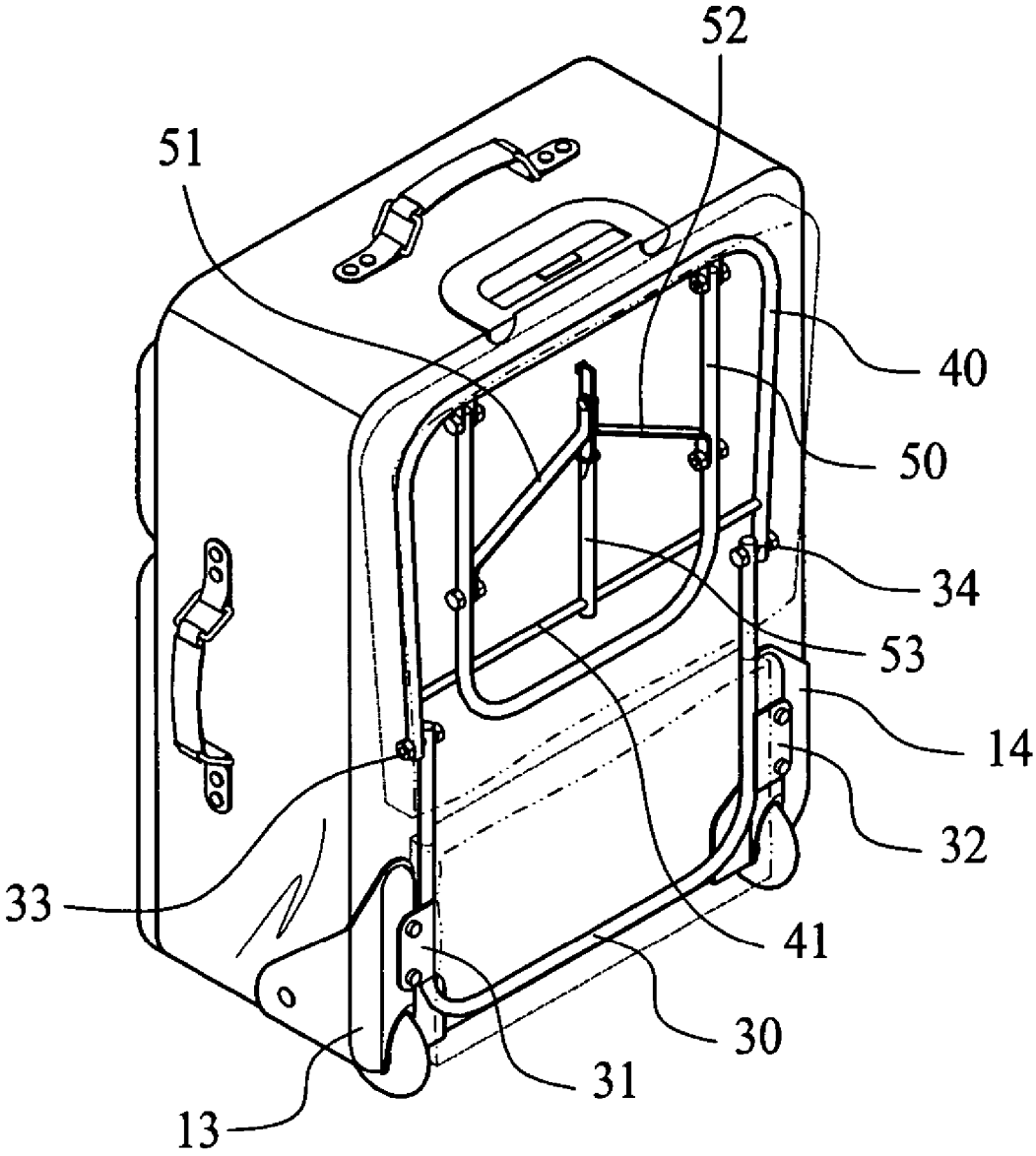
FIG. 2 is a partially phantom view of FIG. 1 showing the folding chair is located inside chair covers that are shown with phantom lines.

Please refer to FIG. 2 that is a partially phantom view of FIG. 1 to show different parts of the folding chair 20 received in the covers 21, 22. As shown, the folding chair 20 includes a base portion 30, a seat portion 40, and a leg portion 50. The base portion 30 is a substantially open-topped U-shaped frame, two lateral bars of which are fixedly connected to two wheel mounts 13, 14 on two rear lower corners of the baggage container 10 via two connecting sleeves 31, 32, so that the base portion 30 is flatly attached to the rear surface 12 of the carry-on baggage container 10.

The seat portion 40 is also a U-shaped frame having an overall width slightly larger than that of the base portion 30, so that free ends of two lateral bars of the U-shaped seat portion 40 are pivotally turnably connected to upper ends of the U-shaped base portion 30 at two pivoting points 33, 34, allowing the whole seat portion 40 to turn about the pivoting points 33, 34 between a folded position, in which the seat portion 40 flatly bears against the rear surface 12 of the baggage container 10, and an extended position, in which the seat portion 40 is in a horizontal plane normal to the rear surface 12 for use. A rear crossbar 41 is connected to and extended between the two lateral bars of the seat portion 40 near the free ends thereof.

The leg portion 50 includes a U-shaped frame having an overall width smaller than that of the base portion 30. Free ends of two lateral bars of the leg portion 50 are pivotally turnably connected to a front crossbar of the U-shaped seat portion 40, so that the leg portion 50 may be movably laid between the two lateral bars of the seat portion 40. The leg portion 50 includes two slant stays 51, 52, two outer ends of which are pivotally turnably connected to the two lateral bars of the U-shaped frame of the leg portion 50, while two inner ends of the slant stays 51, 52 are pivotally connected to a first end of a central bar 53, a second end of which opposite to the first end is pivotally connected to the rear crossbar 41 of the seat portion 40.

Figure 4:
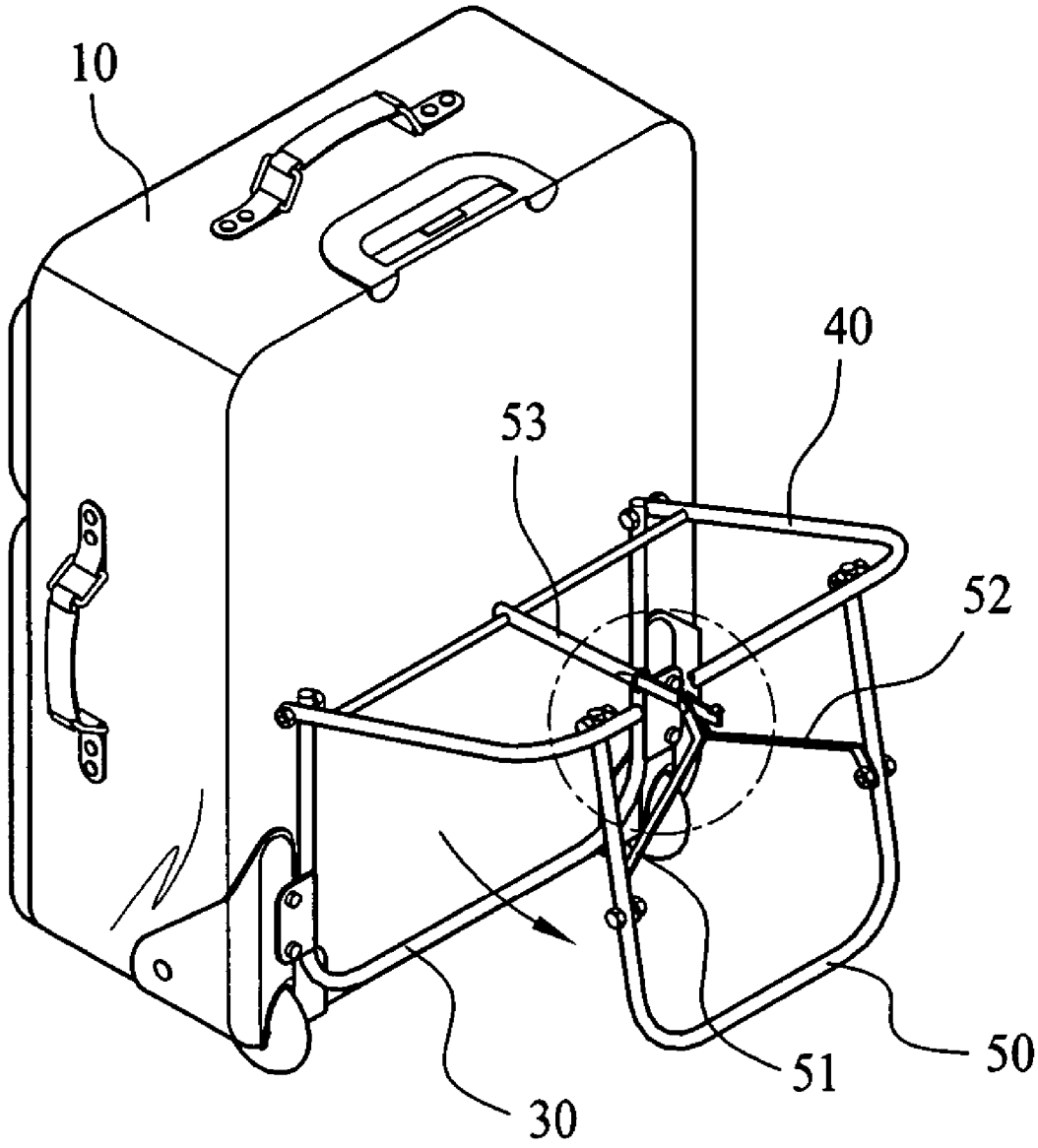
FIG. 4 shows a leg portion of the folding chair of FIG. 3 is pulled to an extended position.
Figure 6:
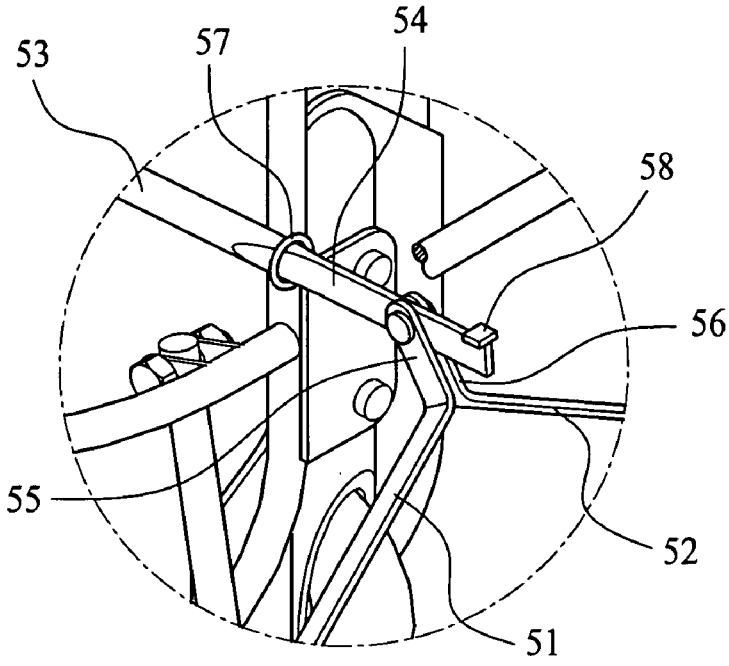
FIG. 6 is an enlarged view of the circled area in FIG. 4.

Please refer to FIGS. 2, 4, and 6 at the same time. In the illustrated preferred embodiment of the present invention, a predetermined length of the central bar 53 of the leg portion 50 extended from the first end thereof is formed into a flat section 54, to which two inner ends 55, 56 of the slant stays 51, 52 are pivotally connected. It is noted the inner ends of the two slant stays 51, 52 are two flat and bent sections 55, 56 with a predetermined angle contained between them and the rest parts of the slant stays 51, 52. A locating ring 57 is movably put on the flat section 54 of the central bar 53, and a stopper 58 is fixedly provided at an outmost point of the flat section 54.

Figure 3:
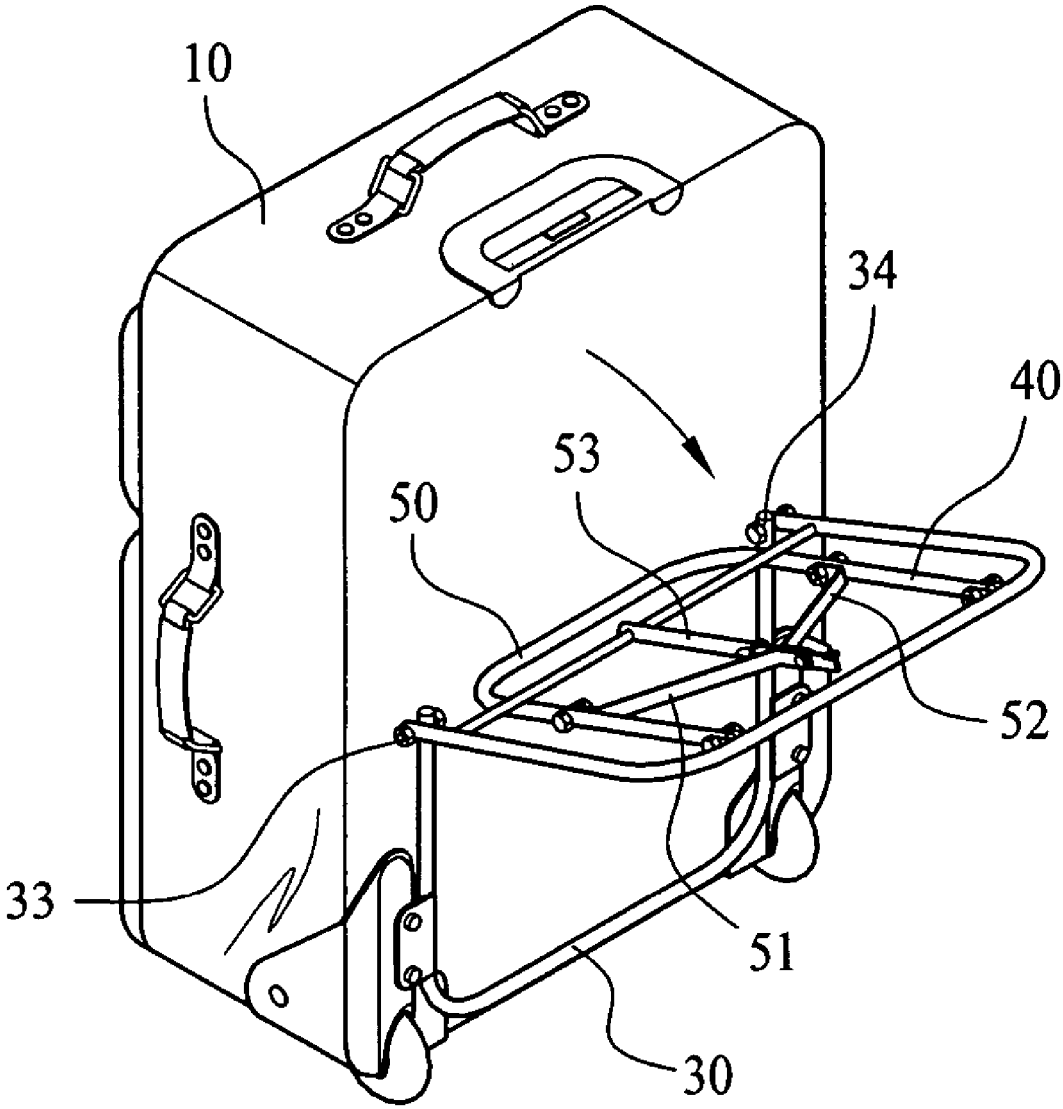
FIG. 3 shows the first step of extending a seat portion of the folding chair provided on the carry-on baggage container of the present invention.
Figure 5:
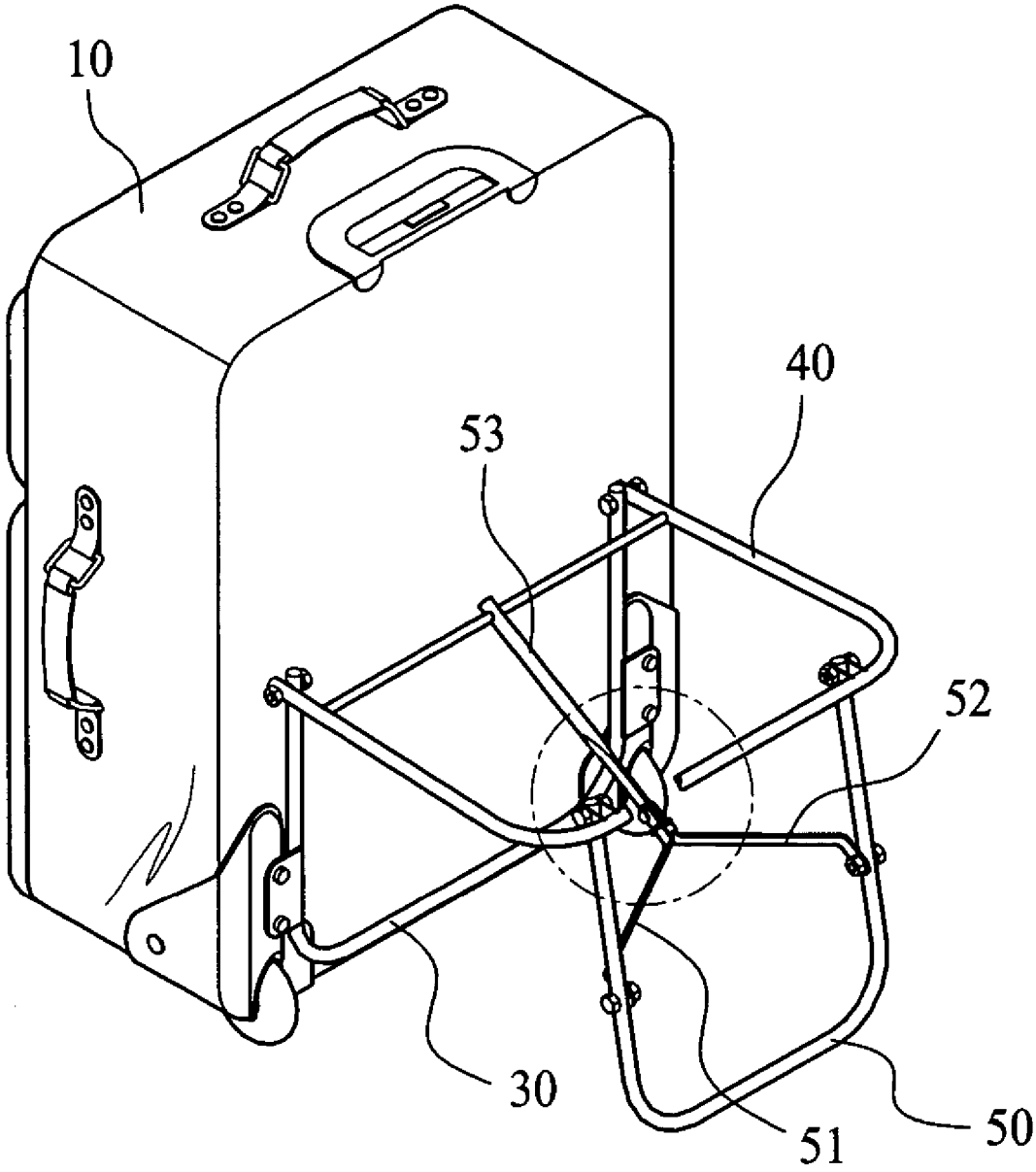
FIG. 5 shows the seat and leg portions of the folding chair of FIG. 4 are held to the extended position.
Figure 7:
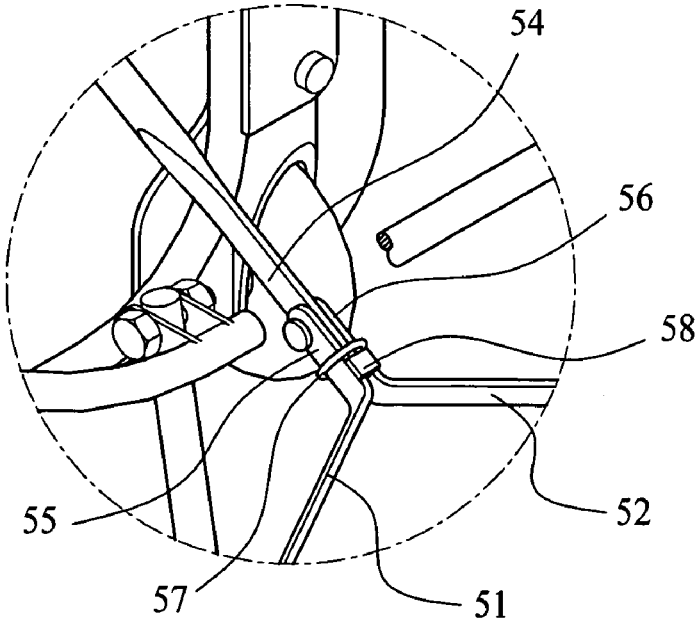
FIG. 7 is an enlarged view of the circled area in FIG. 5.
Figure 8:
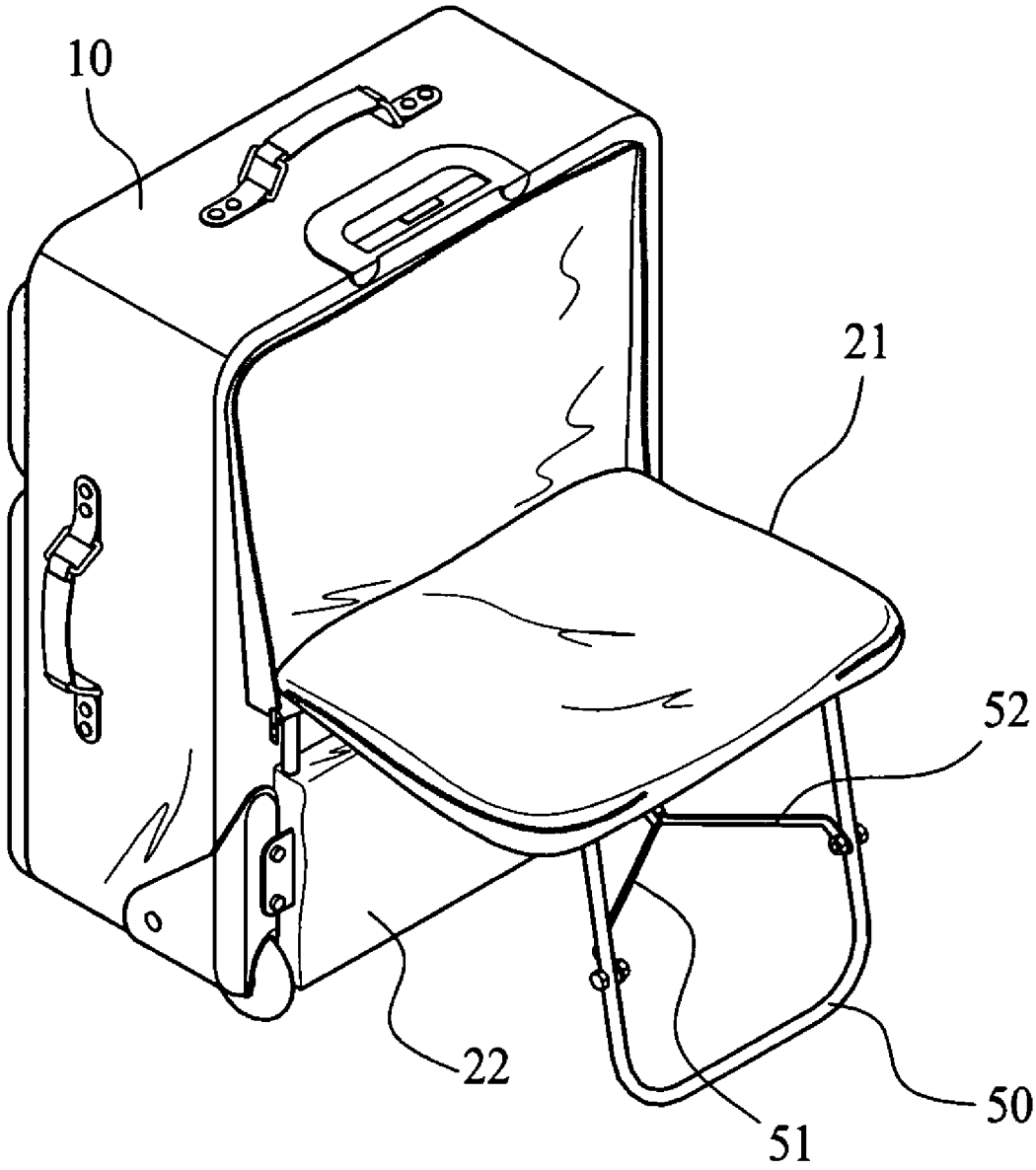
FIG. 8 shows the folding chair on the carry-on baggage container of FIG. 1 is in the extended position for use.

To use the folding chair 20 provided on the carry-on baggage container 10, first turn the seat portion 40 about the pivoting points 33, 34 to outward locate it in a plane approximately normal to the rear surface 12 of the baggage container 10, as shown in FIG. 3. Then, pivotally turn the leg portion 50 to locate it below the seat portion 40, as shown in FIG. 4. While the leg portion 50 is pulled to extend from the seat portion 40, the flat section 54 of the central bar 53 is moved from a position projected from the flat and bent sections 55, 56 of the two slant stays 21, 22, respectively, as shown in FIG. 6, to a position parallelly located between the two flat and bent inner sections 55, 56 of the two slant stays 51, 52 to align with them, as shown in FIG. 7. At this point, the locating ring 57 can be moved to locate around the aligned flat sections 54, 55, and 56, and abut against the stopper 58, holding the seat and the leg portion 40, 50 to a fixed position relative to the base portion 30, as can be most clearly seen from FIGS. 5 and 8. The folding chair 20 in the outward extended position shown in FIGS. 5 and 8 is ready for use. To return the folding chair 20 to the folded position flatly attached to the rear surface 12 of the baggage container 10 when the chair is not in use, simply do the above movements reversely.

With the folding chair 20 provided on the carry-on baggage container 10 in the above-described manner, a traveler may conveniently sit down and take a rest at any time at any place simply by pulling the seat and the leg portions to the extended position for use.

The present invention has been described with a preferred embodiment thereof and it is understood that many changes and modifications in the described embodiment can be carried out without departing from the scope and the spirit of the invention that is to be limited only by the appended claims.

What is claimed is:

1. A carry-on baggage container with a folding chair, comprising a baggage container, and a folding chair that is normally in a folded position flatly attached to one surface of said baggage container and can be turned to an extended position for use; said folding chair comprising a base portion fixedly and flatly connected to said surface of said carry-on baggage container, a seat portion pivotally connected at a rear end to a top of said base portion, and a leg portion pivotally connected at an upper end to a front crossbar of said seat portion; and said leg portion further including two slant stays, of which two outer ends being pivotally connected to two lateral sides of said leg portion and two inner ends being pivotally connected to a first end of a central bar, which is pivotally connected at an opposite second end to a rear crossbar provided on said seat portion opposite to said front crossbar.

2. The carry-on baggage container with a folding chair as claimed in claim 1, wherein said folding chair is located in covers closed with zippers.

3. The carry-on baggage container with a folding chair as claimed in claim 1, wherein said base portion of said folding chair is fixedly connected at two lateral sides to two wheel mounts of said carry-on baggage container via connecting sleeves.

4. The carry-on baggage container with a folding chair as claimed in claim 1, wherein said central bar has a predetermined length extended from said first end being formed into a flat section, and said inner ends of said slant stays being flat and bent sections adapted to pivotally and flatly connect to said flat section of said central bar.

5. The carry-on baggage container with a folding chair as claimed in claim 4, wherein said flat section of said central bar has a locating ring movably put thereon, and a stopper fixedly connected to an outmost point thereof.

* * * * *